US010048629B1

(12) United States Patent
Gan et al.

(10) Patent No.: US 10,048,629 B1
(45) Date of Patent: Aug. 14, 2018

(54) IMAGE FORMING APPARATUS

(71) Applicant: FUJI XEROX CO., LTD., Tokyo (JP)

(72) Inventors: Taijyu Gan, Kanagawa (JP); Yasufumi Suwabe, Kanagawa (JP); Toshihiko Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/718,180

(22) Filed: Sep. 28, 2017

(30) Foreign Application Priority Data

Mar. 15, 2017 (JP) ..... 2017-050093

(51) Int. Cl.
*G03G 15/16* (2006.01)
*G03G 15/00* (2006.01)

(52) U.S. Cl.
CPC ..... *G03G 15/5004* (2013.01); *G03G 15/16* (2013.01); *G03G 15/5054* (2013.01)

(58) Field of Classification Search
USPC ..... 399/38, 42, 45, 66, 110, 121, 297
See application file for complete search history.

(56) References Cited

U.S. PATENT DOCUMENTS 4,931,839 A * 6/1990 Tompkins ..... G03G 15/0131 399/101
7,970,300 B2 6/2011 Tabata et al.
8,781,348 B2 * 7/2014 Ogino ..... G03G 15/1675 399/45
8,787,784 B2 * 7/2014 Miyamoto ..... G03G 15/161 399/314

FOREIGN PATENT DOCUMENTS

JP 2008-107692 A 5/2008
JP 2009-139912 A 6/2009

* cited by examiner

*Primary Examiner* — Hoan Tran
(74) *Attorney, Agent, or Firm* — Sughrue Mion, PLLC

(57) ABSTRACT

An image forming apparatus includes a voltage applying unit that applies a bias voltage for enabling a transfer unit to transfer a developer layer to a transfer medium, the developer layer being retained by an image carrier in accordance with image information; a measuring unit that measures a surface potential of the developer layer; and a setting unit that sets a value of the bias voltage to be applied by the voltage applying unit in accordance with the surface potential measured by the measuring unit, a combined electrostatic capacitance of a surface layer of the image carrier and the developer layer, and an electrostatic capacitance specific to the transfer medium.

7 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2017-050093 filed Mar. 15, 2017.

BACKGROUND

(i) Technical Field

The present invention relates to an image forming apparatus.

(ii) Related Art

When images are formed on transfer media having various surface base materials by supplying developer thereto, there is an appropriate transfer bias for each transfer medium.

SUMMARY

According to an aspect of the invention, there is provided an image forming apparatus including a voltage applying unit that applies a bias voltage for enabling a transfer unit to transfer a developer layer to a transfer medium, the developer layer being retained by an image carrier in accordance with image information; a measuring unit that measures a surface potential of the developer layer; and a setting unit that sets a value of the bias voltage to be applied by the voltage applying unit in accordance with the surface potential measured by the measuring unit, a combined electrostatic capacitance of a surface layer of the image carrier and the developer layer, and an electrostatic capacitance specific to the transfer medium.

BRIEF DESCRIPTION OF THE DRAWINGS

An exemplary embodiment of the present invention will be described in detail based on the following figures, wherein:

FIG. 5A is a characteristic diagram of induced charge amount versus bias potential difference, FIG. 5B is a characteristic diagram of Qp/Qd versus bias potential difference, and FIG. 5C is a characteristic diagram of transfer efficiency versus bias potential difference;

FIG. 6A is a characteristic diagram of induced charge amount versus bias potential difference, FIG. 6B is a characteristic diagram of Qp/Qd versus bias potential difference, and FIG. 6C is a characteristic diagram of transfer efficiency versus bias potential difference.

DETAILED DESCRIPTION

Figure 1:
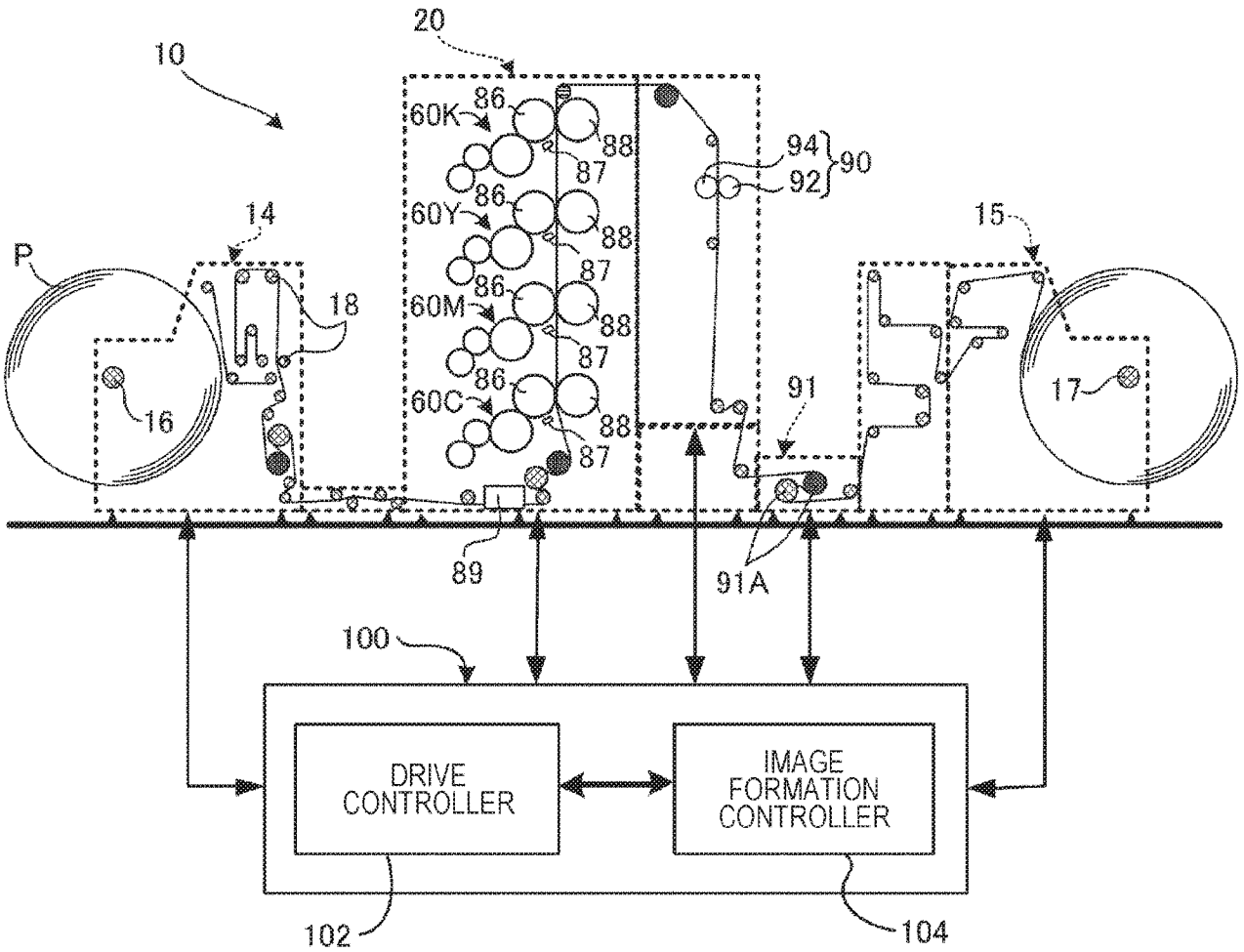
FIG. 1 is a schematic diagram of an image forming apparatus according to an exemplary embodiment.

FIG. 1 illustrates the schematic structure of an image forming apparatus 10 according to an exemplary embodiment. The image forming apparatus 10 according to the present exemplary embodiment uses a liquid developer G (see FIG. 2) as a developer.

A recording medium P is wound around a sheet feeding roller 16 included in a sheet feeding section 14 in layers in advance.

The outermost layer of the recording medium P wound around the sheet feeding roller 16 is pulled off the sheet feeding roller 16, wound around plural winding rollers 18, and fed to an image forming section 20. The image forming section 20 forms an image on the recording medium P, and then the recording medium P is wound around a take-up roller 17, which is included in a storage section 15. The take-up roller 17 rotates so that the recording medium P is wound therearound in layers.

Some of the winding rollers 18 serve as driving rollers so that the recording medium P is wound around the take-up roller 17 while the tension applied to the recording medium P is adjusted in regions between the rollers.

The image forming apparatus 10 includes a controller 100. The controller 100 includes a drive controller 102 and an image formation controller 104. The drive controller 102 controls the operation of a driving system (in particular, motors) for transporting the recording medium P in the sheet feeding section 14, the image forming section 20, and the storage section 15. The image formation controller 104 converts image data received from an external device into exposure data, and controls an image formation process performed by the image forming section 20.

The image forming apparatus 10 according to the present exemplary embodiment forms an image on a surface of the recording medium P by transferring an image (toner image), which is formed of toner particles contained in the liquid developer G (see FIG. 2), onto the surface of the recording medium P and fixing the image.

The image forming section 20 has a function of forming an image on a surface of the recording medium P by forming a toner image with the liquid developer G, transferring the toner image onto the surface of the recording medium P, and fixing the toner to the surface of the recording medium P. The image forming section 20 includes image forming units 60C, 60M, 60Y, and 60K arranged in the vertical direction in FIG. 1 (apparatus height direction), and driving rollers located upstream and downstream of the image forming units 60C, 60M, 60Y, and 60K.

The letters "C", "M", "Y", and "K" attached to the reference numeral respectively represent cyan, magenta, yellow, and black. The image forming units 60C, 60M, 60Y, and 60K respectively form cyan, magenta, yellow, and black toner images. The direction in which the image forming units 60C, 60M, 60Y, and 60K are arranged is not limited to the vertical direction as illustrated in FIG. 1, and may instead be a horizontal direction.

The driving rollers, which are included in the rollers arranged along the transport path of the recording medium P in the image forming apparatus 10, are driven by a driving force transmitted thereto. The rotational speeds of the driving rollers are independently controlled by the drive controller 102 included in the controller 100. For example, to maintain the tension applied to the recording medium P that is being transported within a predetermined range, the transport speed of a downstream driving roller is set so as to be higher than that of an upstream driving roller.

The image forming units 60C, 60M, 60Y, and 60K have a function of forming the toner images of the respective colors and transferring the toner images of the respective colors onto the recording medium P that is transported. The image forming units 60C, 60M, 60Y, and 60K are arranged along the transport path of the recording medium P in that order from an upstream side to a downstream side in the transporting direction of the recording medium P (upward in FIG. 1).

As illustrated in FIG. 1, a fixing device 90 and a drying unit 91 are disposed downstream of the image forming units 60C, 60M, 60Y, and 60K. The fixing device 90 includes a heating roller 92 and a pressing roller 94.

The fixing device 90 has a function of fixing the toner images of the respective colors formed on the surface of the recording medium P by the image forming units 60C, 60M, 60Y, and 60K to the surface of the recording medium P by applying heat and pressure thereto.

The drying unit 91 has a function of drying the recording medium P by winding the recording medium P around drying rollers 91A and applying heat thereto.

The image forming units 60C, 60M, 60Y, and 60K will be described in detail with reference to FIG. 2. In the following description, the letters C, M, Y, and K are omitted. The image forming units 60C, 60M, 60Y, and 60K have the same structure except for the color of the toner contained in the liquid developer G used therein.

Figure 2:
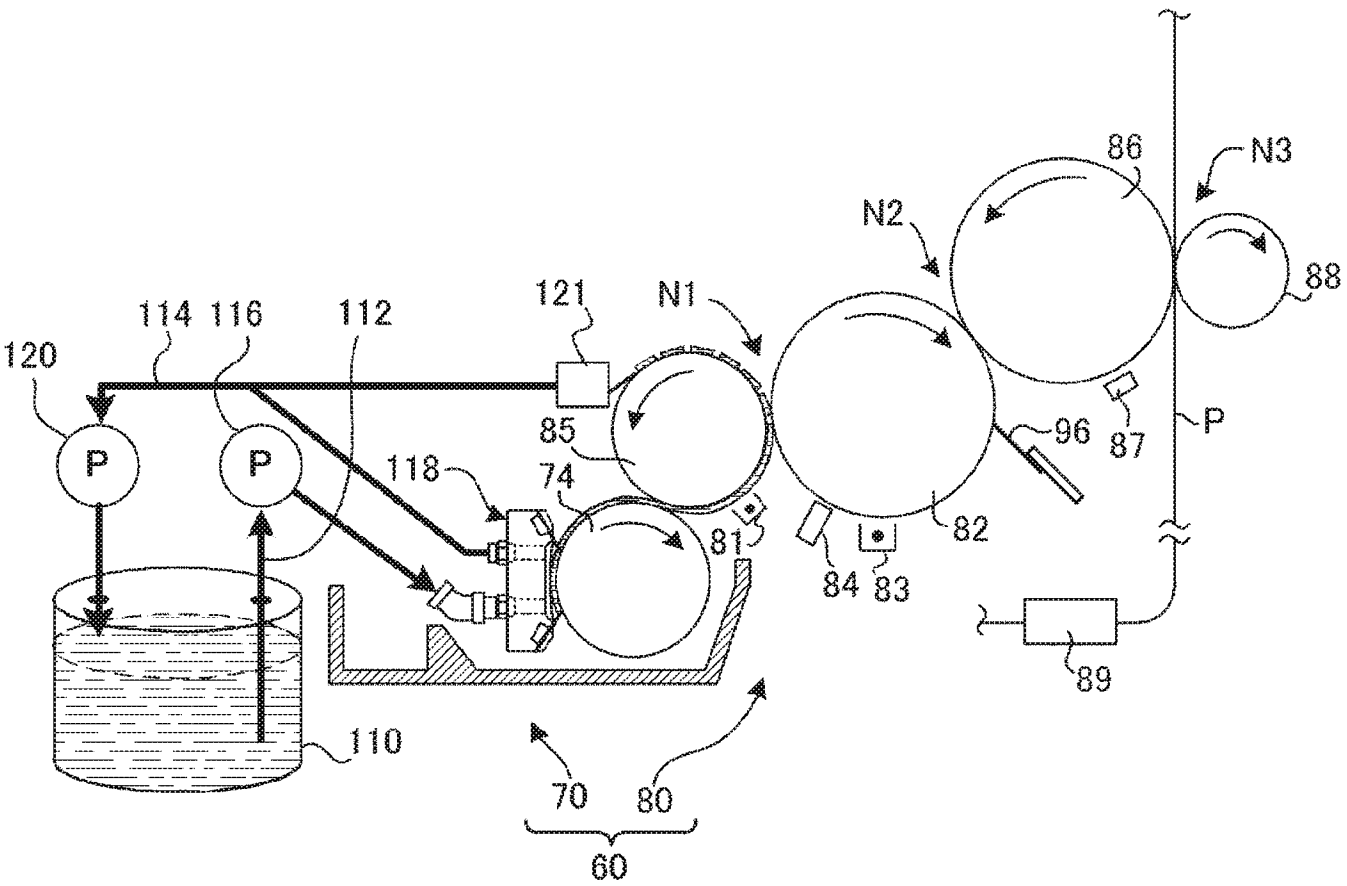
FIG. 2 is a schematic diagram illustrating an image forming unit according to the exemplary embodiment.

As illustrated in FIG. 2, each image forming unit 60 includes a developer supplying unit 70 and a transfer unit 80.

The developer supplying unit 70 has a function of storing the liquid developer G and supplying the liquid developer G to the transfer unit 80.

The developer supplying unit 70 includes a tank 110 in which the liquid developer G is stored. A supply pipe 112 and a collection pipe 114 are attached to the tank 110.

The supply pipe 112 is provided with a supply pump 116 and is connected to an entrance opening of a sealed liquid-developer-supplying device 118 (hereinafter referred to as a "doctor chamber 118"), which is an example of a developer supplier. Accordingly, when the supply pump 116 is driven, the liquid developer G in the tank 110 is supplied to the doctor chamber 118.

The supply pump 116 is a displacement reciprocating pump (hereinafter referred to as a pulsing pump) having a displacement reciprocating supply system. The supply pump 116 supplies the liquid developer G to the doctor chamber 118 at a flow rate having a certain frequency.

The doctor chamber 118 includes a body having a chamber portion for supplying the liquid developer G to a supply roller 74, and a pair of blades for sealing the chamber portion and maintaining a surface radius of the liquid developer G supplied to the supply roller 74 constant.

Thus, the doctor chamber 118 has a function of supplying the liquid developer G in the tank 110 to the supply roller 74, basically without exposing the liquid developer G to the air, while maintaining the surface radius of the liquid developer G on the peripheral surface of the supply roller 74 constant.

Plural grooves that extend in an axial direction are formed in the peripheral surface of the supply roller 74. Since the grooves are formed in the peripheral surface of the supply roller 74, the layer thickness differs between the regions where the grooves are formed and the regions where the grooves are not formed. The grooves are formed so that the retaining force that retains the supplied liquid developer G on the peripheral surface of the supply roller 74 is stronger than that in the case where the liquid developer G having a constant layer thickness is retained on a smooth peripheral surface.

The collection pipe 114 is provided with a collection pump 120 and is connected to an exit opening of the doctor chamber 118. Accordingly, when the collection pump 120 is driven, excess liquid developer G in the doctor chamber 118 is collected in the tank 110. The collection pipe 114 branches at a location upstream of the collection pump 120, and is also connected to a collecting device 121 that collects excess liquid developer G from a peripheral surface of a developing roller 85, which will be described below. The collection pump 120 is also a pulsing pump.

The liquid developer G contains toner particles, which are made of a material having polyester as the base component thereof and which are retained by carrier liquid. Volatile liquid, such as paraffin oil, may be used as the carrier liquid.

The supply roller 74, to which a voltage is applied, rotates while receiving the liquid developer G from the doctor chamber 118 and supplying the liquid developer G to the developing roller 85, which is an example of a developing member and which is located downstream of the supply roller 74. The liquid developer G has a layer thickness adjusted by a blade (not shown) disposed on the supply roller 74, and is supplied to the developing roller 85, to which a voltage is applied. A charging device 81 faces the peripheral surface of the developing roller 85. The charging device 81 charges the liquid developer G with, for example, a positive electric charge.

The transfer unit 80 includes a photoconductor drum 82, a photoconductor charging device 83, an exposure device 84, the developing roller 85, an intermediate transfer roller 86, and a backup roller 88.

The transfer unit 80 transfers a toner image onto the recording medium P. The toner image is formed on the photoconductor drum 82, which serves as an image carrier and which is located downstream of the developing roller 85, by using the liquid developer G.

The photoconductor drum 82 has a function of retaining a latent image. The photoconductor charging device 83 has a function of uniformly charging the surface of the photoconductor drum 82.

The exposure device 84 has a function of forming a latent image on the surface of the photoconductor drum 82, which is charged by the photoconductor charging device 83, on the basis of image data received by the image formation controller 104 (see FIG. 1). The latent image is formed in a region irradiated with a light beam from the exposure device 84 so as to be charged to a potential different from the surface potential of the uniformly charged surface.

The developing roller 85 has a function of developing the latent image retained by the photoconductor drum 82 into a toner image by using the liquid developer G supplied from the developer supplying unit 70.

The developing roller 85 and the photoconductor drum 82 form a nip N1. The developing roller 85 rotates while a voltage is applied thereto, thereby developing the latent image retained by the photoconductor drum 82 into the toner image by using an electric field formed at the nip N1.

The intermediate transfer roller 86 is located downstream of the photoconductor drum 82, and has a function of allowing the toner image formed on the photoconductor drum 82 to be transferred onto the outer peripheral surface thereof in a first transfer process, and retaining the toner image.

The intermediate transfer roller 86 and the photoconductor drum 82 form a nip N2. The intermediate transfer roller 86 rotates while a voltage of, for example, −500 V is applied thereto, thereby allowing the toner image on the photoconductor drum 82 to be transferred onto the outer peripheral surface thereof in the first transfer process by using an electric field formed at the nip N2.

The photoconductor drum 82 is provided with a cleaning blade 96 that removes toner particles that have not been transferred at the nip N2 in the first transfer process.

The backup roller 88 has a function of causing the toner image retained on the outer peripheral surface of the intermediate transfer roller 86 to be transferred onto the transported recording medium P in a second transfer process. The backup roller 88 opposes the intermediate transfer roller 86 with the transport path of the recording medium P interposed therebetween, and forms a nip N3 together with the intermediate transfer roller 86.

The toner image retained on the outer peripheral surface of the intermediate transfer roller 86 is transferred onto the recording medium P in the second transfer process by using an electric field formed between the photoconductor drum 82 and the recording medium P at the nip N3.

Figure 3:
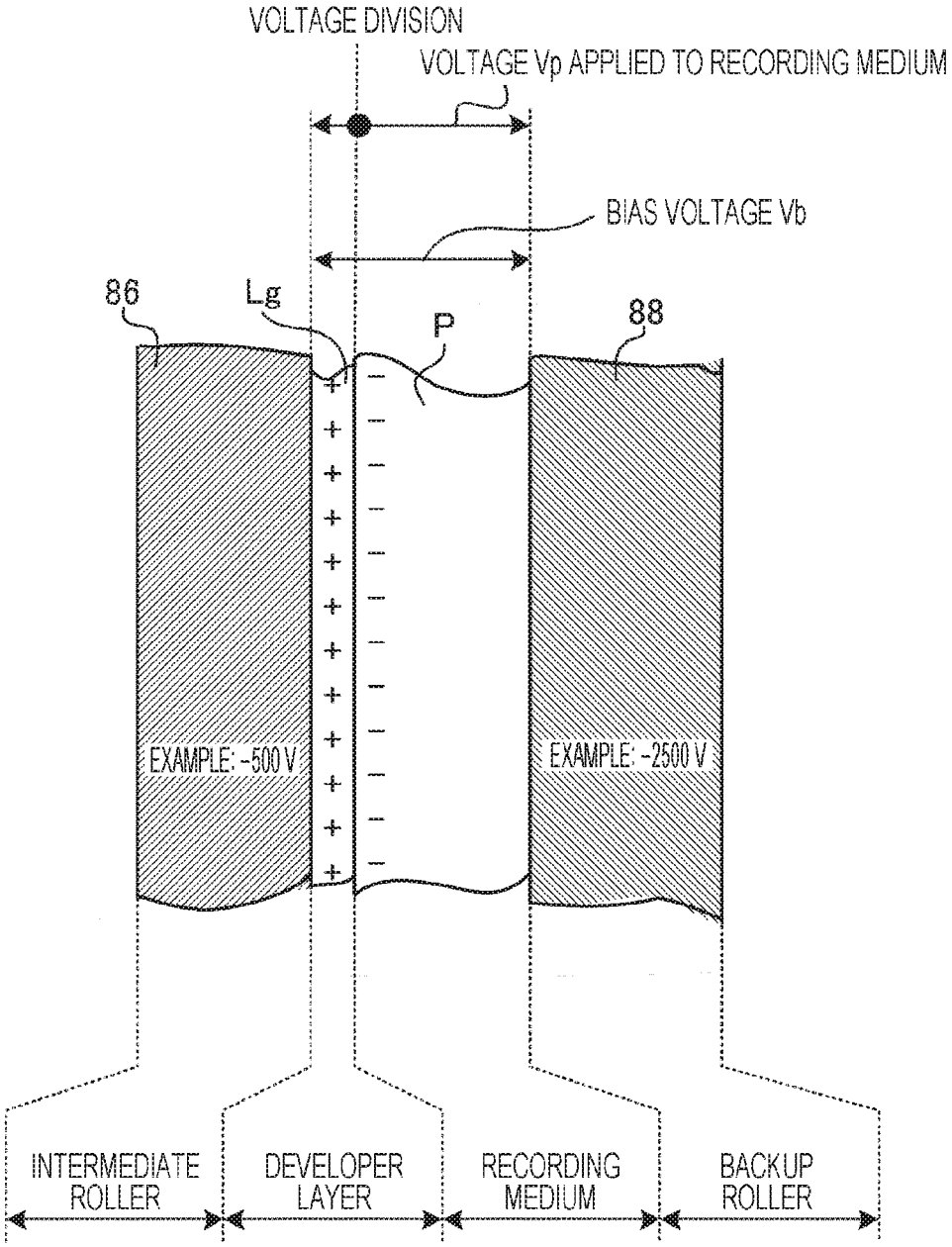
FIG. 3 is an enlarged view of a nip illustrated in FIG. 2.

As illustrated in FIG. 3, the liquid developer G is positively charged (see the plus signs in FIG. 3). Accordingly, when an image is to be transferred from the intermediate transfer roller 86 to the recording medium P, a negative voltage that is lower than the voltage applied to the intermediate transfer roller 86 is applied to the backup roller 88 so that the liquid developer G transfers to the recording medium P at the nip N3. The voltage applied to the intermediate transfer roller 86 is, for example, −500 V. The voltage to be applied to the backup roller 88 depends on the thickness of the recording medium P, and is −2500 V in this example.

The difference between the voltage applied to the backup roller 88 and the voltage applied to the intermediate transfer roller 86 (bias potential difference Vb) is divided in accordance with the ratio between the electrostatic capacitance of the layer of the liquid developer G (hereinafter referred to as a developer layer Lg) and the electrostatic capacitance of the recording medium P.

Accordingly, a voltage Vp applied to the recording medium P at the nip N3 is lower than the bias potential difference Vb.

If the difference in the thickness of the recording medium P depending on the type of the recording medium P is around 10%, the bias potential difference Vb may be set to a potential that allows for the difference (10%). However, when, for example, the thickness of the recording medium P varies in the range of 10 μm to 500 μm or when the relative dielectric constant of the recording medium P varies depending on the material thereof, it may be difficult to appropriately process all types of recording media P if the bias potential difference Vb is fixed.

Accordingly, in the present exemplary embodiment, the image formation controller 104 (see FIG. 1) performs preparation process control at the time when the type of the recording medium P to be used is determined and before a normal image formation process is performed. In the preparation process control, the bias potential difference Vb is set by using the electrostatic capacitances of the developer layer Lg and the recording medium P so that the induced charge amount Qp (per unit area) of the recording medium P, which varies depending on the type (electrostatic capacitance) of the recording medium P, is greater than or equal to the charge amount Qd (per unit area) of the developer layer Lg. The induced charge amount Qp is the absolute value of an amount of charge induced on a surface of the recording medium P (surface that faces the developer layer Lg) when the recording medium P is regarded as a dielectric layer (capacitor) and when a potential difference is applied between both sides of the recording medium P. When the induced charge amount Qp is greater than or equal to the charge amount Qd of the developer layer Lg, all of the toner particles in the developer layer Lg may be transferred to the recording medium P.

The principle for setting the bias potential difference Vb by using the electrostatic capacitances of the developer layer Lg and the recording medium P will now be described.

Considering the fact that the charge amount Q is determined by the product of the electrostatic capacitance C and the voltage V, a surface electrometer 87, which measures a surface potential Vd of the developer layer Lg, is disposed so as to face the peripheral surface of the intermediate transfer roller 86. The surface electrometer 87 measures the surface potential Vd of the developer layer Lg when, for example, an image is formed based on solid black image information.

The charge amount Qd of the developer layer Lg is determined from the measured surface potential Vd and a combined electrostatic capacitance Ct. The combined electrostatic capacitance Ct is obtained by combining the electrostatic capacitance Cd of the developer layer Lg and the electrostatic capacitance Cc of the intermediate transfer roller 86, which are known.

$$Qd=Ct\lambda Vd \quad (1)$$

An electrostatic capacitance measurement device 89 is provided to measure the electrostatic capacitance Cp of the recording medium P. The electrostatic capacitance Cp is determined by sandwiching the recording medium P between metal plates disposed at the front and back sides of the transport path of the recording medium P, applying a predetermined voltage between the metal plates, and detecting an amount of charge that flows. More specifically, the electrostatic capacitance Cp of the recording medium P is obtained by sandwiching the recording medium P with a pair of electrodes having a known area and dividing the detected charge amount by the applied voltage.

The electrostatic capacitance measurement device 89 acquires the electrostatic capacitance Cp of the recording medium P (first acquisition unit).

The electrostatic capacitance Cp may be acquired by another method instead of using the first acquisition unit. More specifically, a table showing the relationship between the type of the recording medium P and the electrostatic capacitance Cp may be stored in advance. The type of the recording medium P may be input (for example, manually or by reading an identification symbol on the recording medium P), and the electrostatic capacitance Cp may be determined by referring to the table showing the relationship between the type of the recording medium P and the electrostatic capacitance Cp (second acquisition unit).

The induced charge amount Qp of the recording medium P is determined by the electrostatic capacitance Cp specific to the recording medium P, which is a constant, and the voltage Vp applied to the recording medium P, which is a variable.

$$Qp=Cp\times Vp \quad (2)$$

Accordingly, in a graph having a horizontal axis (x axis) representing the voltage Vp applied to the recording medium P and a vertical axis (y axis) representing the induced charge amount Qp of the recording medium P, the induced charge amount Qp of the recording medium P varies in direct proportion to the voltage Vp applied to the recording medium P.

Therefore, the voltage Vp at which the induced charge amount Qp of the recording medium P is equal to the charge amount Qd of the developer layer Lg (Qp=Qd) may be easily determined.

The determined voltage Vp is a partial voltage of the bias potential difference Vb that is applied to the recording medium P (see FIG. 3). Therefore, the bias potential difference Vb is determined by using the voltage division ratio between the recording medium P and the developer layer Lg.

The voltage division ratio is determined by the ratio between the electrostatic capacitance Cd of the developer layer Lg and the electrostatic capacitance Cp specific to the recording medium P. The voltage division ratio is the inverse of the ratio between Cd and Cp).

Therefore, the bias potential difference Vb is determined as in Equation (3):

$$\begin{aligned} V_b &= Vp/(1-(Cp/(Cd+Cp))) \\ &= Vp/\{Cd/Cd+Cp)\} \end{aligned} \quad (3)$$

The voltages applied to the intermediate transfer roller 86 and the backup roller 88 may be set on the basis of the bias potential difference Vb calculated by Equation (3).

For example, FIG. 3 shows the case in which the bias potential difference Vb is set to −2000 V. When the voltage applied to the intermediate transfer roller 86 is −500 V and the voltage applied to the backup roller 88 is −2500 V, a voltage of −2000 V is applied to the nip N3, and 100% of the toner particles may be transferred.

The operation of the present exemplary embodiment will now be described.

Flow of Image Forming Process

The flow of the process for forming an image by the image forming apparatus 10 will be described.

When the controller 100 receives image data, the controller 100 converts the image data into exposure data items of the respective colors, and transmits the exposure data items of the respective colors to the exposure devices 84 included in the image forming units 60.

Next, based on an image formation execution instruction, the image forming unit 60C operates so that the photoconductor charging device 83C charges the photoconductor drum 82C, and that the charged photoconductor drum 82C is exposed to light by the exposure device 84C. Thus, a cyan latent image is formed on the photoconductor drum 82C. The cyan latent image is developed into a cyan toner image by the developing roller 85C, to which cyan liquid developer G is supplied from the developer supplying unit 70C.

Next, the cyan toner image is moved to the nip N2 by the rotation of the photoconductor drum 82C, and is transferred onto the intermediate transfer roller 86C in the first transfer process. The cyan toner image that has been transferred onto the intermediate transfer roller 86C is moved to the nip N3 by the rotation of the intermediate transfer roller 86C. After reaching the nip N3, the cyan toner image is transferred onto the surface of the transported recording medium P by the backup roller 88C.

Similarly, in the image forming units 60M, 60Y, and 60K, which are included in the image forming units 60, magenta, yellow, and black toner images are successively transferred onto the surface of the recording medium P from the intermediate transfer rollers 86M, 86Y, and 86K in the second transfer process so as to be superposed on the cyan toner image that has been transferred onto the recording medium P in the second transfer process.

After the toner images of the respective colors are formed on the surface of the recording medium P by the image forming units 60, the recording medium P reaches the fixing device 90. The fixing device 90 fixes the toner images of the respective colors on the surface of the recording medium P to the surface of the recording medium P by applying heat and pressure. Next, the recording medium P passes through the drying unit 91 so that the recording medium P is dried, and is then wound around the take-up roller 17 in the storage section 15.

The recording medium P is typically non-conductive normal paper Pn, such as paper or a resin film.

Image Formation Preparation Process Control

Figure 4:
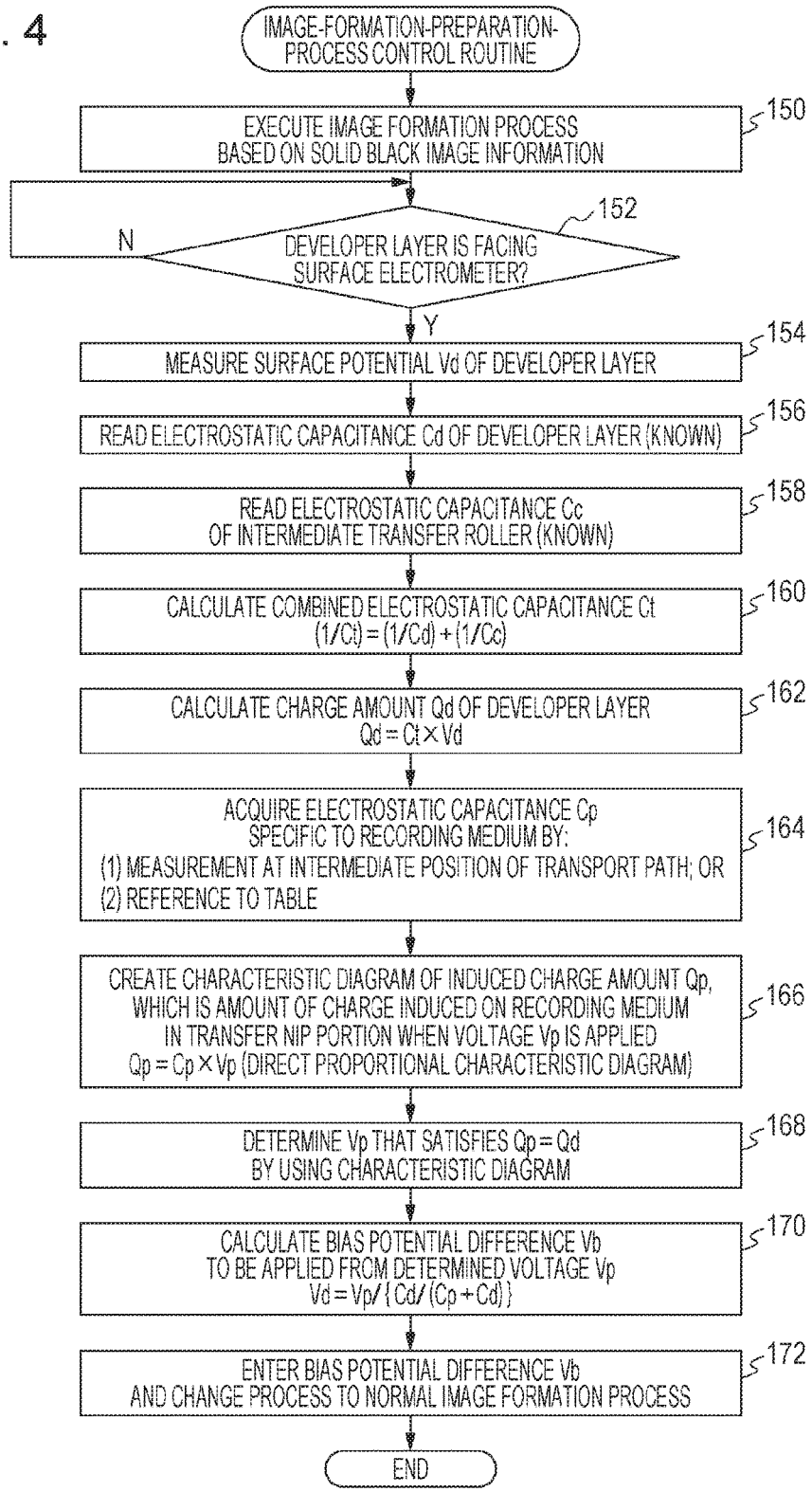
FIG. 4 is a flowchart of an image-formation-preparation-process control routine according to the exemplary embodiment.

An image-formation-preparation-process control routine will be described with reference to a flowchart illustrated in FIG. 4. This routine is executed by the image formation controller 104 to set the bias potential difference Vb by using the electrostatic capacitances of the developer layer Lg and the recording medium P so that the induced charge amount Qp, which depends on the type of the recording medium P (thickness and relative dielectric constant), is greater than or equal to the charge amount Qd of the developer layer Lg. This process is performed at the time when the type of the recording medium P to be used is determined and before a normal image formation process is performed.

In step 150, an image formation process is executed based on solid black image information.

Next, in step 152, it is determined whether the developer layer Lg, which develops a solid black image, is facing the surface electrometer 87. If yes, the process proceeds to step 154, and the surface potential Vd of the developer layer Lg is measured.

Next, in step 156, the electrostatic capacitance Cd of the developer layer (known) is read. Then, in step 158, the electrostatic capacitance Cc of the intermediate transfer roller 86 (known) is read. Then, in step 160, the combined electrostatic capacitance Ct is calculated from the electrostatic capacitance Cd of the developer layer and the electrostatic capacitance Cc of the intermediate transfer roller 86.

Next, in step 162, the charge amount Qd of the developer layer Lg is calculated from Equation (1).

$$Qd = Ct \times Vd \quad (1)$$

Next, the process proceeds to step 164, and the electrostatic capacitance Cp specific to the recording medium P is acquired.

In the present exemplary embodiment, the electrostatic capacitance Cp is measured by the electrostatic capacitance measurement device 89 disposed on the transport path of the recording medium P (first acquisition unit). The electrostatic capacitance Cp is determined by sandwiching the recording medium P between metal plates disposed at the front and back sides of the recording medium P, applying a predetermined voltage between the metal plates, and detecting an amount of charge that flows.

Alternatively, a table showing the relationship between the type of the recording medium P and the electrostatic capacitance Cp may be stored in advance. The type of the recording medium P may be input, and the electrostatic capacitance Cp may be determined by referring to the table showing the relationship between the type of the recording medium P and the electrostatic capacitance Cp (second acquisition unit). The type of the recording medium P may, for example, be input manually or by reading an identification symbol on the recording medium P.

Next, in step 166, the characteristic diagram of the induced charge amount Qp is created. The induced charge amount Qp is the amount of charge induced on the recording medium P when the voltage Vp is applied to the recording medium P at the transfer nip portion (nip N3).

The characteristic diagram has a horizontal axis (x axis) representing the voltage Vp applied to the recording medium P and a vertical axis (y axis) representing the induced charge amount Qp of the recording medium P. The induced charge amount Qp of the recording medium P varies in direct proportion to the voltage Vp applied to the recording medium P.

$$Qp=Cp\times Vp \quad (2)$$

In step 168, the voltage Vp that satisfies Qp=Qd is determined by referring to the characteristic diagram created in step 166. Then, the process proceeds to step 170, and the bias potential difference Vb to be applied is calculated from the determined voltage Vp by using Equation (3).

$$Vb=Vp/\{Cd/(Cd+Cp)\} \quad (3)$$

Next, in step 172, the bias potential difference Vb is set as a bias potential difference for normal image formation, and an instruction for changing the process to the normal image formation process is issued. Then, this routine is ended.

Example 1

A bias potential difference Vb for an image formation process performed on an adhesive label film having a thickness of 160 μm (PET50A PAT1 8LK produced by Lintec Corporation) based on solid black image information is determined.

The electrostatic capacitance Cp of the label film (PET50A PAT1 8LK) per unit area is 2.0E-7 F/$m^2$. The charge amount Qd of the developer layer Lg formed on the intermediate transfer roller 86 per unit area is about 380 μC/$m^2$.

Figure 5A:
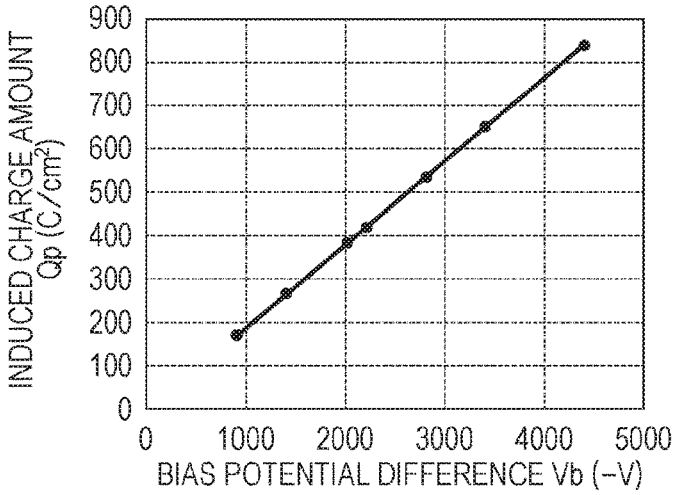
FIGS. 5A to 5C are graphs of Example 1 of the exemplary embodiment, where

FIG. 5A is a characteristic diagram of the induced charge amount Qp per unit area when the bias potential difference Vb is varied according to the present exemplary embodiment.

Referring to FIG. 5A, to transfer all of the liquid developer G, the bias potential difference Vb may be set so that the induced charge amount Qp exceeds the charge amount Qd of the developer layer Lg. In this example, the charge amount Qd of the developer layer Lg is about 380 μC/$m^2$. Therefore, the bias potential difference Vb at which the induced charge amount Qp exceeds the charge amount Qd of the developer layer Lg is estimated to be about −2000 V.

Figure 5B:
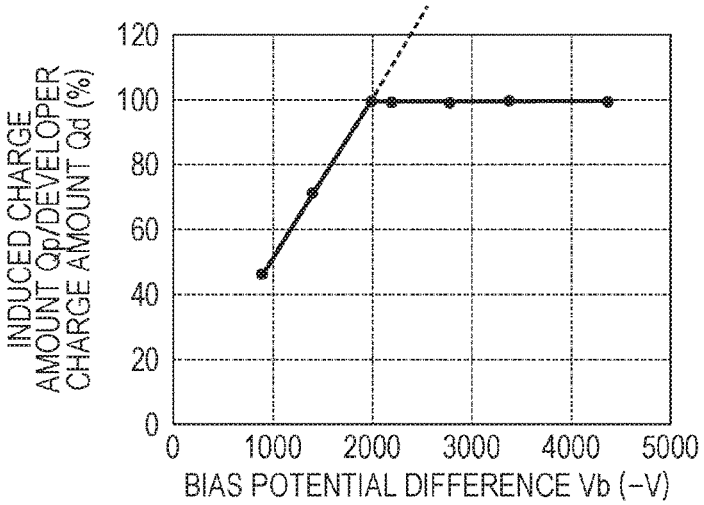

FIG. 5B is a characteristic diagram in which the vertical axis of FIG. 5A is changed to Qp/Qd, that is, to the ratio of the developer charge amount Qd to the induced charge amount Qp. FIG. 5B enables estimation of the amount of liquid developer G that may be transferred with respect to the applied bias potential difference Vb.

Theoretically, the characteristic curve linearly extends as shown by the dotted line. However, the ratio is plotted at 100% in the range in which the ratio exceeds 100%.

Figure 5C:
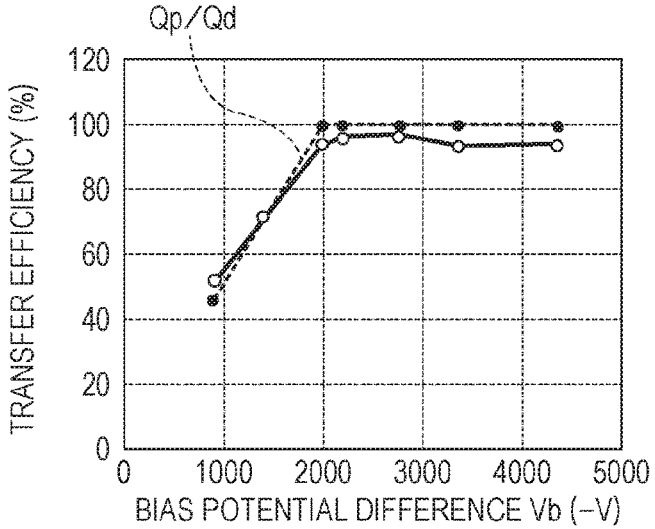

FIG. 5C is a characteristic diagram showing the transfer efficiency that is experimentally obtained when the image formation process based on the solid black image information is performed on the label film (PET50A PAT1 8LK) by the image forming apparatus 10 according to the present exemplary embodiment while the bias potential difference Vb applied at the transfer nip (nip N3) is varied.

The optical density Dp of the image (developer image) transferred onto the recording medium P and the optical density Dt of the developer that remains on the intermediate transfer roller 86 are measured, and the transfer efficiency E (%) is determined as E=(Dp/(Dp+Dt))×100.

A comparison between the characteristic curves in FIG. 5B and FIG. 5C shows that the measured transfer efficiency (see FIG. 5C) with respect to the applied bias potential difference matches the estimated value (see FIG. 5B) within an acceptable range.

When the image density is to be adjusted, the bias potential difference Vb may be set so that the ratio of the induced charge amount Qp to the developer charge amount Qd is equal to a desired value.

Depending on the type of the recording medium P, the recording medium P may have an electrostatic capacitance that locally varies due to, for example, uneven thickness of an adhesive layer of an adhesive label film. When the bias potential difference Vb for such a recording medium P is set so that the ratio of the induced charge amount Qp to the developer charge amount Qd is 100%, there is a risk that the induced charge amount Qp will be insufficient in local regions where the electrostatic capacitance is low. As a result, spot-shaped image defects may occur due to transfer failure. In such a case, an appropriate transfer image that is free from image defects may be formed by setting the bias potential difference Vb to a value at which the ratio of the induced charge amount Qp to the developer charge amount Qd is sufficiently higher than 100% (for example, 110%). For example, referring to FIG. 3, when the bias potential difference Vb at which the ratio of the induced charge amount Qp to the developer charge amount Qd is 100% is −2000 V, the image defects may be reduced by setting the bias potential difference Vb to about −2200 V.

Example 2

A bias potential difference Vb for an image formation process performed on a polyethylene terephthalate (PET) film having a thickness of 12 μm (T4102 produced by Toyobo Co., Ltd.) based on solid black image information is determined by a procedure similar to that in Example 1.

The electrostatic capacitance Cp of the PET film (T4102) per unit area is 1.2E-6 F/$m^2$. The charge amount Qd of the developer layer Lg formed on the intermediate transfer roller 86 per unit area is about 380 μC/$m^2$.

Figure 6A:
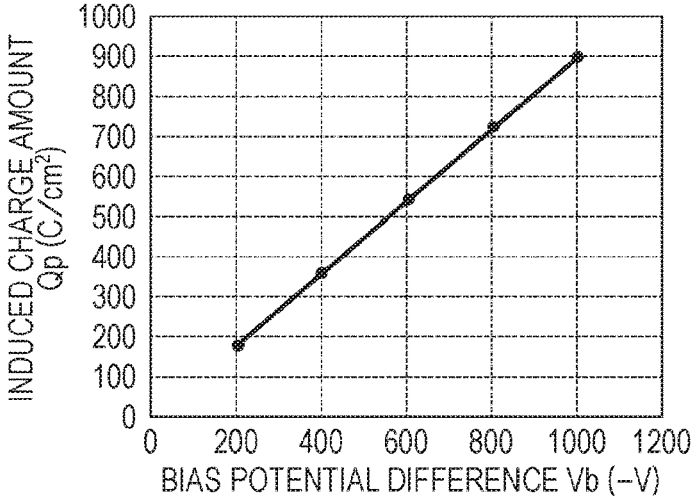
FIGS. 6A to 6C are graphs of Example 2 of the exemplary embodiment, where

FIG. 6A is a characteristic diagram of the induced charge amount Qp per unit area when the bias potential difference Vb is varied.

Figure 6B:
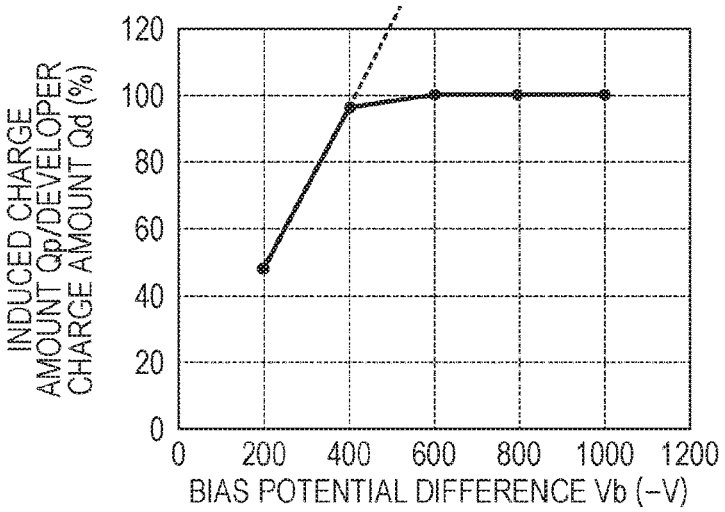

FIG. 6B is a characteristic diagram showing the relationship between the bias potential difference Vb and the estimated transfer efficiency (ratio of the induced charge amount Qp to the charge amount Qd of the developer layer Lg).

Figure 6C:
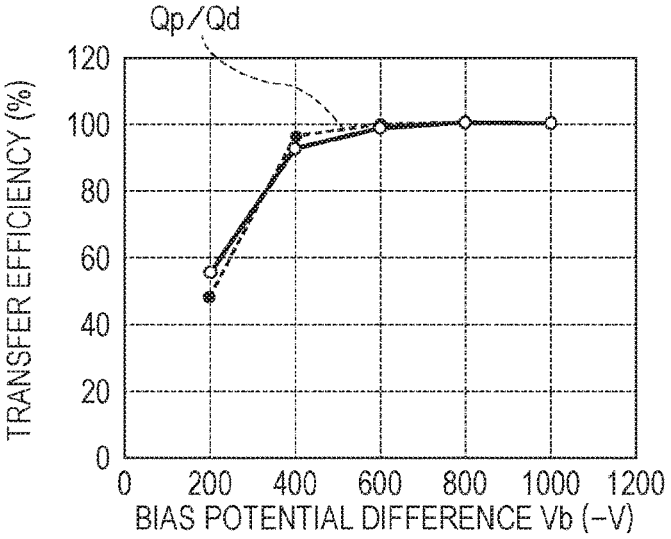

FIG. 6C is a characteristic diagram showing the transfer efficiency that is experimentally obtained when the image formation process based on the solid black image information is performed on the PET film "T4102" by the image forming apparatus 10 according to the present exemplary embodiment while the bias potential difference Vb applied at the transfer nip (nip N3) is varied.

A comparison between FIG. 6B and FIG. 6C shows that the measured transfer efficiency (see FIG. 6C) with respect to the applied bias potential difference Vb matches the estimated value (see FIG. 6B) within an acceptable range.

Accordingly, it is clear that the setting of the bias potential difference Vb according to the present exemplary embodiment is useful even when the characteristics, such as the layer structure, electrostatic capacitance, and thickness, of the recording medium P greatly vary as in Examples 1 and 2.

In the present exemplary embodiment, the bias potential difference Vb is set by determining the voltage Vp that satisfies Qp=Qd. However, transferring at a ratio of 100% may be achieved if Qp Qd is satisfied.

In, for example, a color image formation process in which multiple image forming units successively perform a developing process, the recording medium P may be charged in a previous image formation process. It is difficult to eliminate the charge because the fixing process is not yet performed. Accordingly, the bias potential difference for the first image forming unit may be set to the minimum required value, that is, to the bias potential difference Vb corresponding to the voltage Vp that satisfies Qp=Qd.

Figure 7:
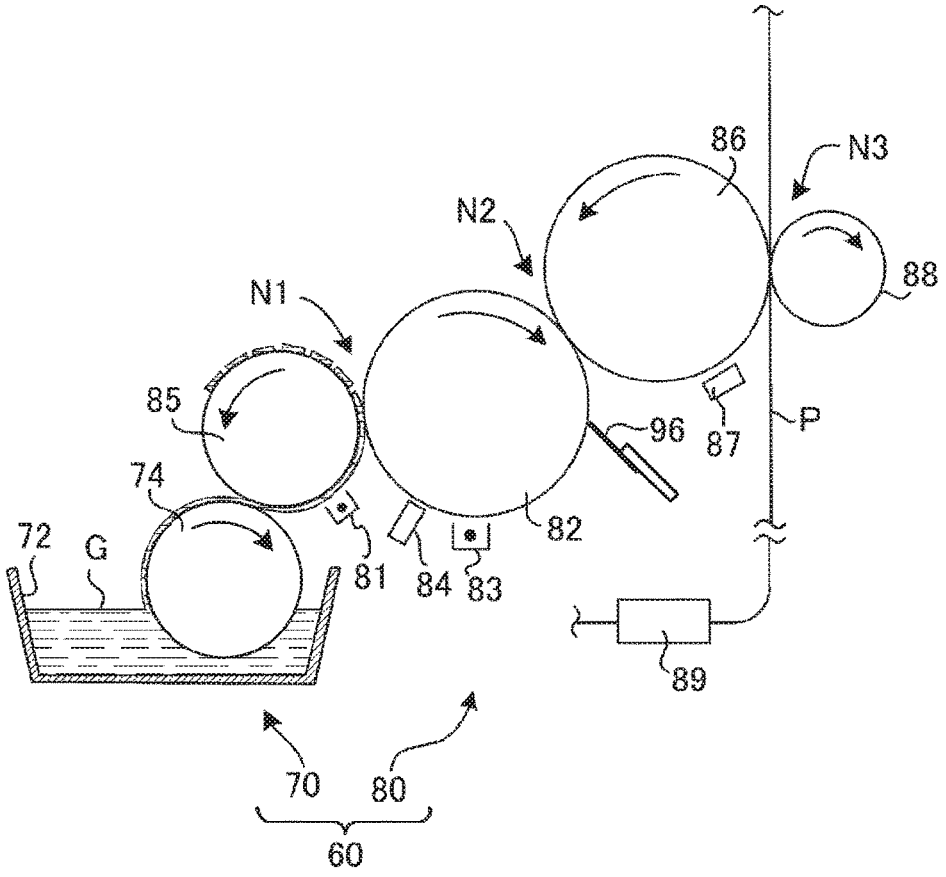
FIG. 7 is a front view of a liquid developer reservoir according to a modification.

In the present exemplary embodiment, as illustrated in FIG. 2, the sealed liquid-developer-supplying device 118 (doctor chamber 118) is provided, and the liquid developer G in the tank 110 is supplied to the supply roller 74 through the doctor chamber 118 by driving the supply pump 116. Alternatively, however, as illustrated in FIG. 7, the liquid developer G may be stored in a tank 72, and the supply roller 74 may be partially immersed in the liquid developer G stored in the tank 72. The liquid developer G may be brought up by rotating the supply roller 74.

Although the liquid developer G is used in the present exemplary embodiment, developer containing dry toner particles may instead be used. In this case, the developer layer Lg is a layer of toner particles.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a voltage applying unit that applies a bias voltage for enabling a transfer unit to transfer a developer layer to a transfer medium, the developer layer being retained by an image carrier in accordance with image information;

a measuring unit that measures a surface potential of the developer layer; and a setting unit that sets a value of the bias voltage to be applied by the voltage applying unit in accordance with the surface potential measured by the measuring unit, a combined electrostatic capacitance of a surface layer of the image carrier and the developer layer, and an electrostatic capacitance specific to the transfer medium.

2. The image forming apparatus according to claim 1, wherein the setting unit sets the value of the bias voltage so that an amount of charge induced on the transfer medium at a location of the transfer unit is greater than or equal to an amount of charge of the developer layer.

3. The image forming apparatus according to claim 2, further comprising:

a charge amount measuring unit that determines, before the setting unit sets the value of the bias voltage, the electrostatic capacitance specific to the transfer medium from a voltage applied between a pair of electrode plates having a predetermined area that sandwich the transfer medium and an integrated value of a current that flows per unit time when the voltage is applied.

4. The image forming apparatus according to claim 2, further comprising:

a storage unit that stores identification information used to determine a type of the transfer medium and an electrostatic capacitance specific to the type of the transfer medium in association with each other.

5. The image forming apparatus according to claim 1, further comprising:

a charge amount measuring unit that determines, before the setting unit sets the value of the bias voltage, the electrostatic capacitance specific to the transfer medium from a voltage applied between a pair of electrode plates having a predetermined area that sandwich the transfer medium and an integrated value of a current that flows per unit time when the voltage is applied.

6. The image forming apparatus according to claim 1, further comprising:

a storage unit that stores identification information used to determine a type of the transfer medium and an electrostatic capacitance specific to the type of the transfer medium in association with each other.

7. The image forming apparatus according to claim 1, wherein a plurality of the transfer units are arranged in a direction in which the transfer medium is transported, the transfer units transferring a plurality of the developer layers onto the transfer medium in a superposed manner, and wherein the setting unit sets a minimum required bias voltage at which an amount of charge induced on the transfer medium at a location of each of the transfer units is equal to an amount of charge of a corresponding one of the developer layers.

* * * * *